US010188189B1

(12) United States Patent
McNally et al.

(10) Patent No.: US 10,188,189 B1
(45) Date of Patent: Jan. 29, 2019

(54) CONNECTED CONTAINERS FOR RAZOR CARTRIDGES

(71) Applicant: The Gillette Company LLC, Boston, MA (US)

(72) Inventors: Patrick Francis McNally, Pawtucket, RI (US); Jessy Lee Cusack, Somerville, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 15/664,234

(22) Filed: Jul. 31, 2017

(51) Int. Cl.
*A45D 27/22* (2006.01)
*B65D 21/02* (2006.01)

(52) U.S. Cl.
CPC ..... *A45D 27/225* (2013.01); *B65D 21/0204* (2013.01); *B65D 21/0205* (2013.01)

(58) Field of Classification Search
CPC ..... B65D 21/0204; B65D 21/0205; B65D 83/10; A45D 27/225; A45D 27/22; A45D 27/24
USPC ..... 206/352, 354
See application file for complete search history.

(56) References Cited

U.S. PATENT DOCUMENTS 3,343,706 A * 9/1967 Berend ..... A47B 88/90 220/23.4
3,703,326 A * 11/1972 Riviers ..... A47B 81/04 206/822
3,908,828 A * 9/1975 Lohwasser ..... B65D 21/0202 206/504
5,330,055 A 7/1994 Kendra et al.
6,185,827 B1 2/2001 Polites
8,083,089 B2 * 12/2011 Vovan ..... B65D 43/162 220/270
8,573,428 B2 11/2013 Furuta
2004/0040960 A1 * 3/2004 Gledhill ..... B65D 21/0204 220/23.4
2011/0139648 A1 * 6/2011 Sonnenberg ..... A45D 27/225 206/354
2015/0076025 A1 3/2015 Wilmers et al.

OTHER PUBLICATIONS

U.S. Appl. No. 14/816,285, filed Aug. 3, 2015, Matthew Corey Cataudella et al.
U.S. Appl. No. 15/372,786, filed Dec. 8, 2016, Kelly Daniel Bridges et al.

* cited by examiner

*Primary Examiner* — King M Chu
(74) *Attorney, Agent, or Firm* — Kevin C. Johnson

(57) ABSTRACT

First and second individual containers each containing a razor cartridge with a storage region and having a perimeter around an entrance to the storage region. Each container includes a first side wall, a second side wall opposite the first side wall, a first end wall, a second end wall opposite the first end wall, a bottom wall extending between the first side wall, the second side wall, the first end wall and the second end wall. A front flange extends outward from the first side wall at the perimeter. A joint secures the front flange of the second individual container to the second side wall of the first individual container at the perimeter. The front flange of the second individual container extends beyond the second side wall of the first individual container and above the storage region of first individual container.

13 Claims, 13 Drawing Sheets

CONNECTED CONTAINERS FOR RAZOR CARTRIDGES

FIELD OF THE INVENTION

The present invention relates to a container for a razor cartridge and more particularly to a plurality of connected containers for razor cartridges.

BACKGROUND OF THE INVENTION

The need for protective containers for razor cartridges has long been recognized. Protective containers protect both the user from accidental injury from exposed cutting edges of the blades within the razor cartridge and protects the razor cartridges and blades themselves from nicks and other damage. In general, there are two types of protective containers: a container for holding an individual razor cartridge and a tray-type container for holding multiple razor cartridges.

The two types of containers have certain advantages and disadvantages. For example, individual containers may be simple and provide a more efficient use of packaging space when quantities of cartridges other than the tray size are used; yet they may be inconvenient both to a manufacturer and a user for storing multiple razor cartridges together. In another example, while a tray-type container is convenient for storing together multiple razor cartridges its flexibility is limited as it can only store a fixed number of razor cartridges.

Another type of container allows individual containers to be connected in a side-by-side relationship. Allowing protective casings to be connected in a side-by-side relationship provides the manufacturer with flexibility to connect together the desired number of protecting casings, e.g., two, three, four, etc. Such containers are often symmetrical providing little or no distinction between the front and the back of the container. Such a lack of distinction can make it difficult for the user to properly orient the container for connection of the razor cartridge with a handle.

Thus, there is a desire to overcome the problem associated with prior art protective casings by providing individual containers that are connected to one another and have a clear orientation to allow the user to correctly connect the stored razor cartridge with a handle.

SUMMARY OF THE INVENTION

The present invention relates to a plurality of connected individual containers for a razor cartridge comprising a first individual container containing a first razor cartridge and a second individual container containing a second razor cartridge. The first individual container comprises a plastic container defining a storage region and having a perimeter around an entrance to the storage region. The container comprises a first side wall, a second side wall opposite the first side wall, a first end wall, a second end wall opposite the first end wall, a bottom wall extending between the first side wall, the second side wall, the first end wall and the second end wall, and a front flange extending outward from said first side wall at said perimeter. A first razor cartridge is positioned or stored within the storage region. The second individual container comprises a plastic container defining a storage region and having a perimeter around an entrance to the storage region. The container comprises a first side wall, a second side wall opposite the first side wall, a first end wall, a second end wall opposite the first end wall, a bottom wall extending between the first side wall, the second side wall, the first end wall and the second end wall, and a front flange extending outward from said first side wall at said perimeter. A second razor cartridge is positioned within the storage region. A joint secures the front flange of the second individual container to the second side wall of the first individual container at the perimeter with the front flange of the second individual container extending beyond said second side wall of the first individual container and above the storage region of first individual container.

The joint may comprise a weld, a mechanical joint, or an adhesive. Alternatively, the joint may comprise a staple or a rivet.

The weld may comprise an ultrasonic weld or a laser weld.

The front flange of the first individual container may be at a non-perpendicular angle to the first side wall of the first individual container. The front flange of the second individual container may be at a non-perpendicular angle to the first side wall of the second individual container.

The front flange of the first individual container may be perpendicular to the first side wall of the first individual container. The front flange of the second individual container may be perpendicular to the first side wall of the second individual container.

The present invention relates to a plurality of connected individual containers for a razor cartridge comprising a first individual container containing a first razor cartridge and a second individual container containing a second razor cartridge. The first individual container comprises a plastic container defining a storage region and having a perimeter around an entrance to the storage region. The container comprises a first side wall, a second side wall opposite the first side wall, a first end wall, a second end wall opposite the first end wall, a bottom wall extending between the first side wall, the second side wall, the first end wall and the second end wall, a first end flange extending outward from said first end wall at said perimeter, a second end flange extending outward from said second end wall at said perimeter, and a front flange extending outward from said first side wall at said perimeter. A first razor cartridge is positioned or stored within the storage region. The second individual container comprises a plastic container defining a storage region and having a perimeter around an entrance to the storage region. The container comprises a first side wall, a second side wall opposite the first side wall, a first end wall, a second end wall opposite the first end wall, a bottom wall extending between the first side wall, the second side wall, the first end wall and the second end wall, a first end flange extending outward from said first end wall at said perimeter, a second end flange extending outward from said second end wall at the perimeter, and a front flange extending outward from said first side wall at said perimeter. A second razor cartridge is positioned within the storage region. A joint secures the front flange of the second individual container to the second side wall of the first individual container at the perimeter with the front flange of the second individual container extending beyond said second side wall of the first individual container and above the storage region of first individual container.

The joint may comprise a weld, a mechanical joint, or an adhesive.

The weld may comprise an ultrasonic weld or a laser weld.

The first end flange of the first individual container may be perpendicular to the first end wall of the first individual container. The first end flange of the second individual container may be perpendicular to the first end wall of the second individual container.

The second end flange of the first individual container may be perpendicular to the second end wall of the first individual container. The second end flange of the second individual container may be perpendicular to the second end wall of the second individual container.

The first end flange of the first individual container may be at a non-perpendicular angle to the first end wall of the first individual container. The first end flange of the second individual container may be at a non-perpendicular angle to the first end wall of the second individual container.

The second end flange of the first individual container may be at a non-perpendicular angle to the second end wall of the first individual container. The second end flange of the second individual container may be at a non-perpendicular angle to the second end wall of the second individual container.

The front flange of the first individual container may be at a non-perpendicular angle to the first side wall of the first individual container. The front flange of the second individual container may be at a non-perpendicular angle to the first side wall of the second individual container.

The front flange of the first individual container may be perpendicular to the first side wall of the first individual container. The front flange of the second individual container may be perpendicular to the first side wall of the second individual container.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
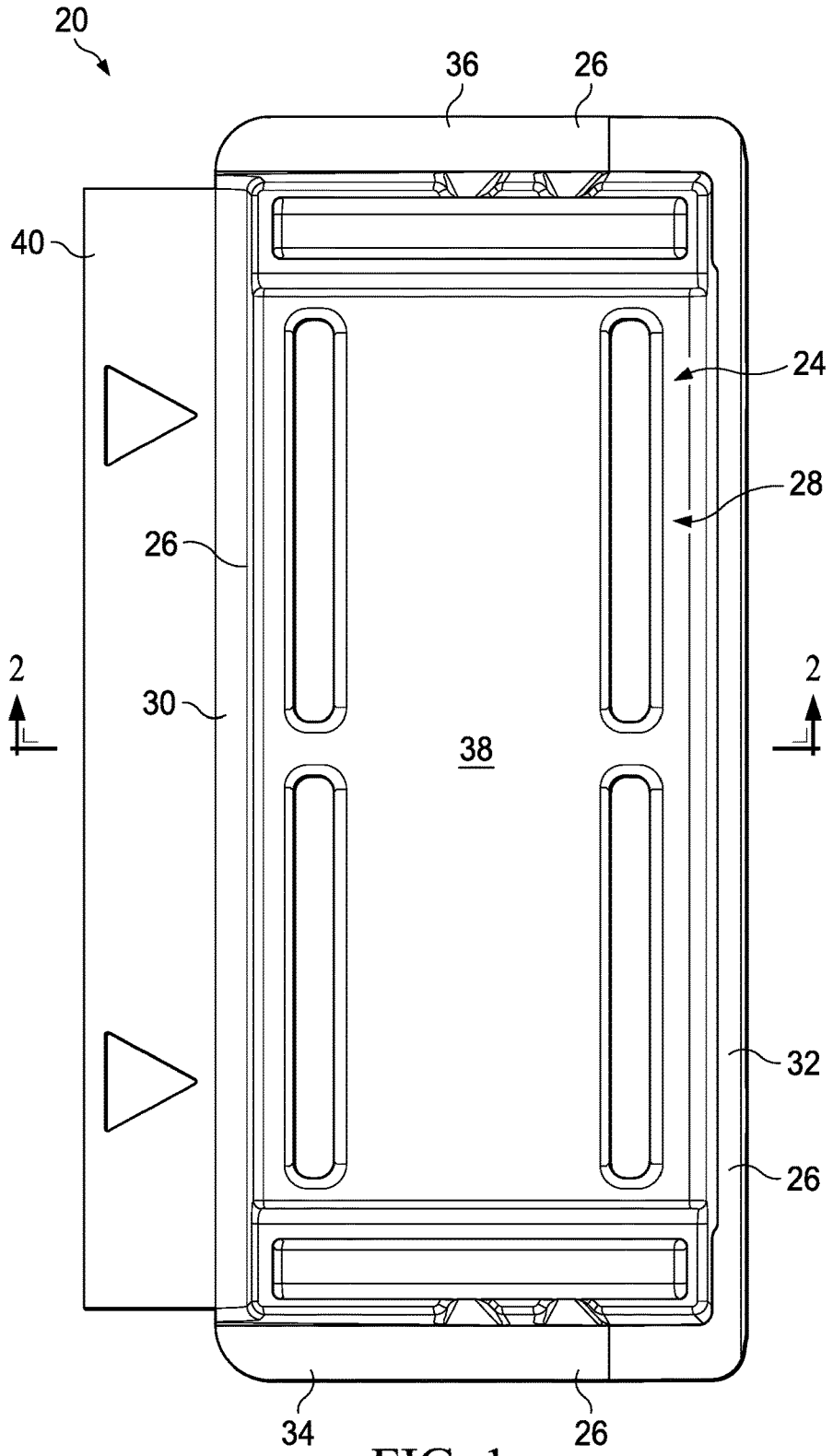
FIG. 1 is a top plan view of a container of the present invention.
Figure 2:
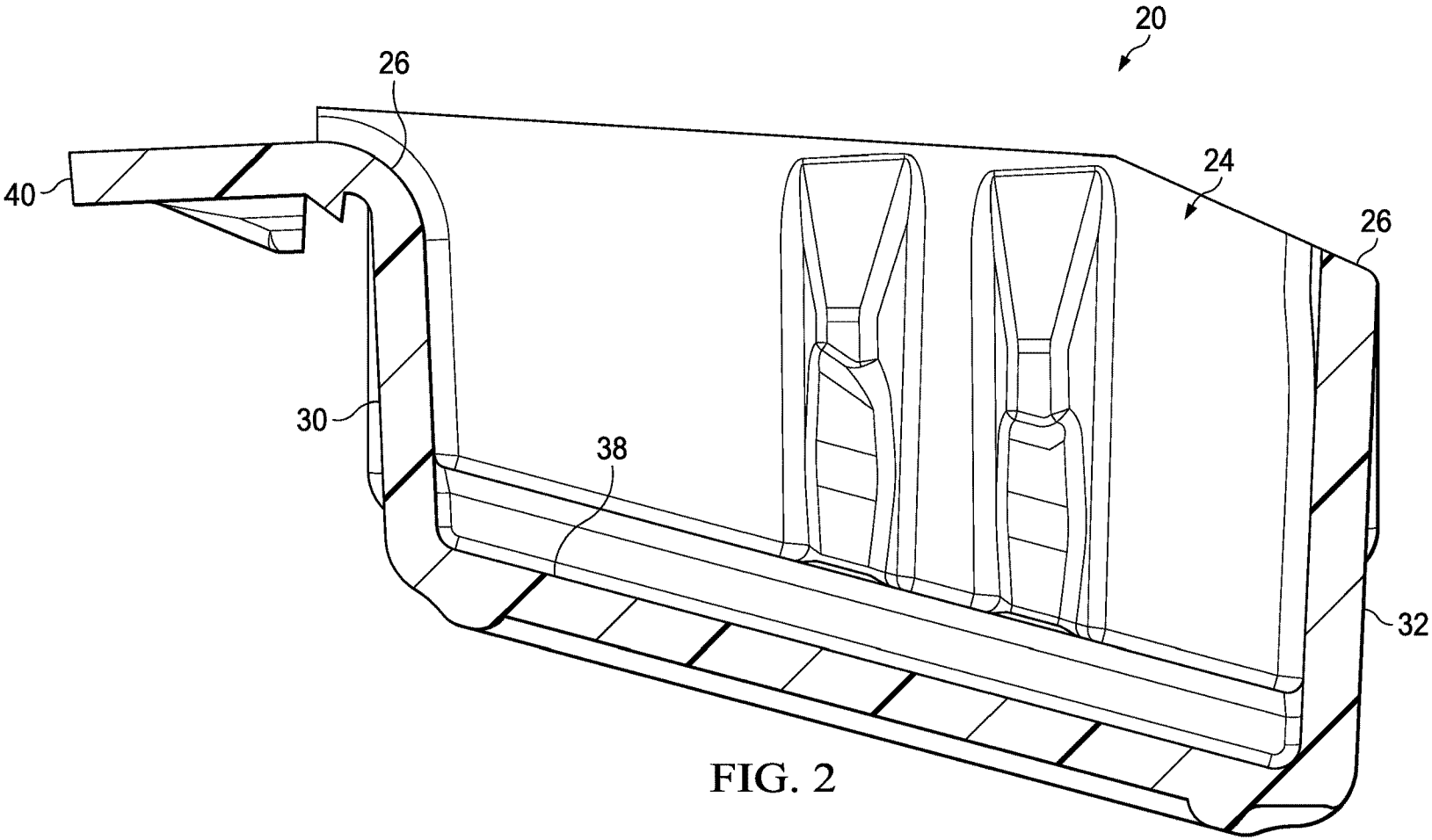
FIG. 2 is a cross-sectional view of the container of FIG. 1.

Referring to FIGS. 1-2 there is shown a first individual container 20 of the present invention. The container 20 is sized to contain a razor cartridge, not shown in FIGS. 1-2. The container 20 preferably comprises a plastic container defining a storage region 24 and having a perimeter 26 surrounding an entrance 28 to the storage region 24. The container 20 has a first side wall 30, a second side wall 32 opposite the first side wall 30, a first end wall 34, a second end wall 36 opposite the first end wall 34 and a bottom wall 38 extending between the first side wall 30, the second side wall 32, the first end wall 34 and the second end wall 36. A front flange 40 extends outward from the first side wall 30 at the perimeter 26. The front flange 40 is perpendicular to the first side wall 30.

Figure 3:
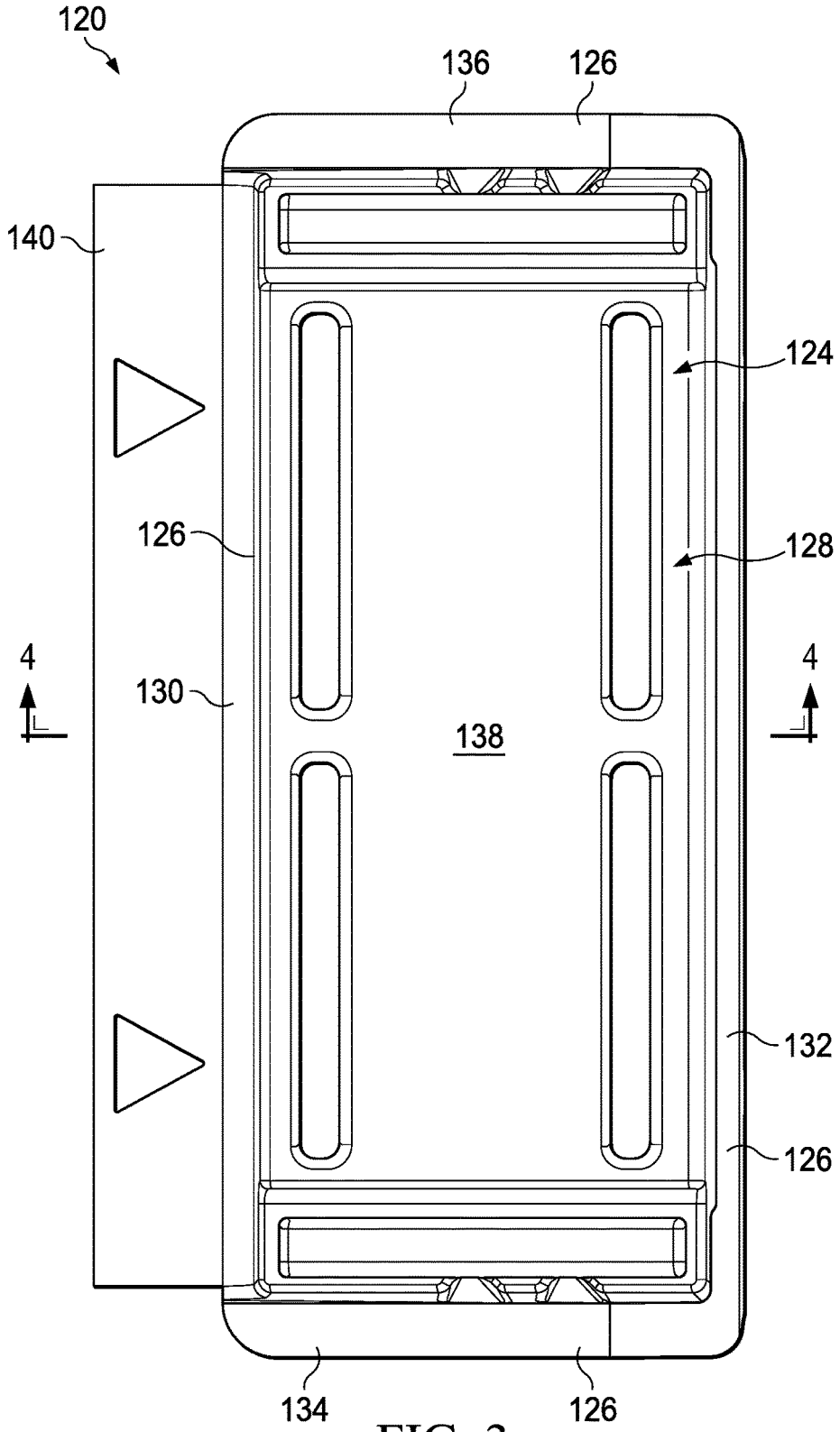
FIG. 3 is a top plan view of a container of the present invention.
Figure 4:
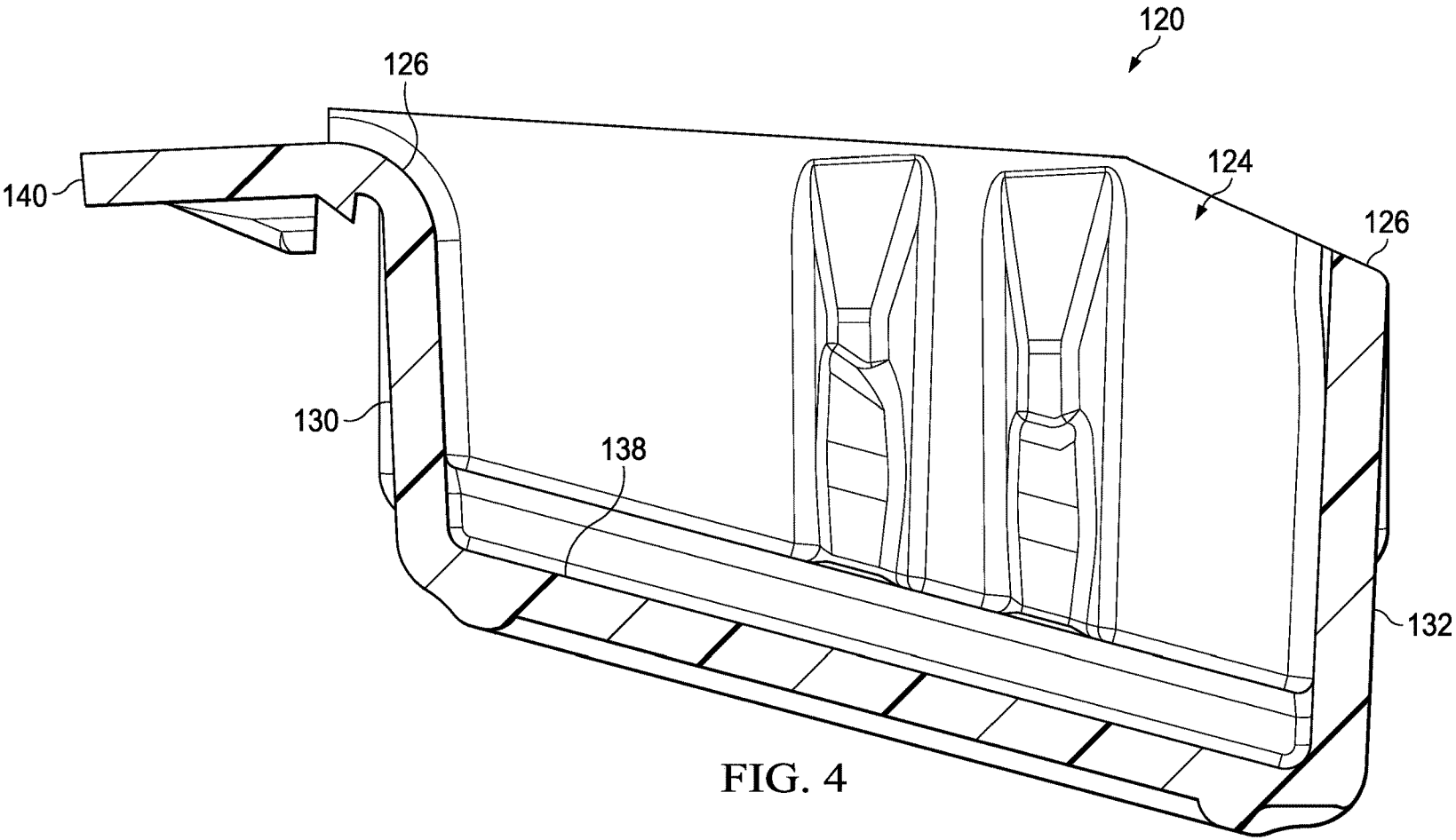
FIG. 4 is a cross-sectional view of the container of FIG. 3.

Referring to FIGS. 3-4 there is shown a second individual container 120 of the present invention. The container 120 is sized to contain a razor cartridge, not shown in FIGS. 3-4. The second container 120 is the same as first container 20. The second container 120 preferably comprises a plastic container defining a storage region 124 and having a perimeter 126 surrounding an entrance 128 to the storage region 124. The container 120 has a first side wall 130, a second side wall 132 opposite the first side wall 130, a first end wall 134, a second end wall 136 opposite the first end wall 134 and a bottom wall 138 extending between the first side wall 130, the second side wall 132, the first end wall 134 and the second end wall 136. A front flange 140 extends outward from the first side wall 130 at the perimeter 126. The front flange 140 is perpendicular to the first side wall 130.

Figure 5:
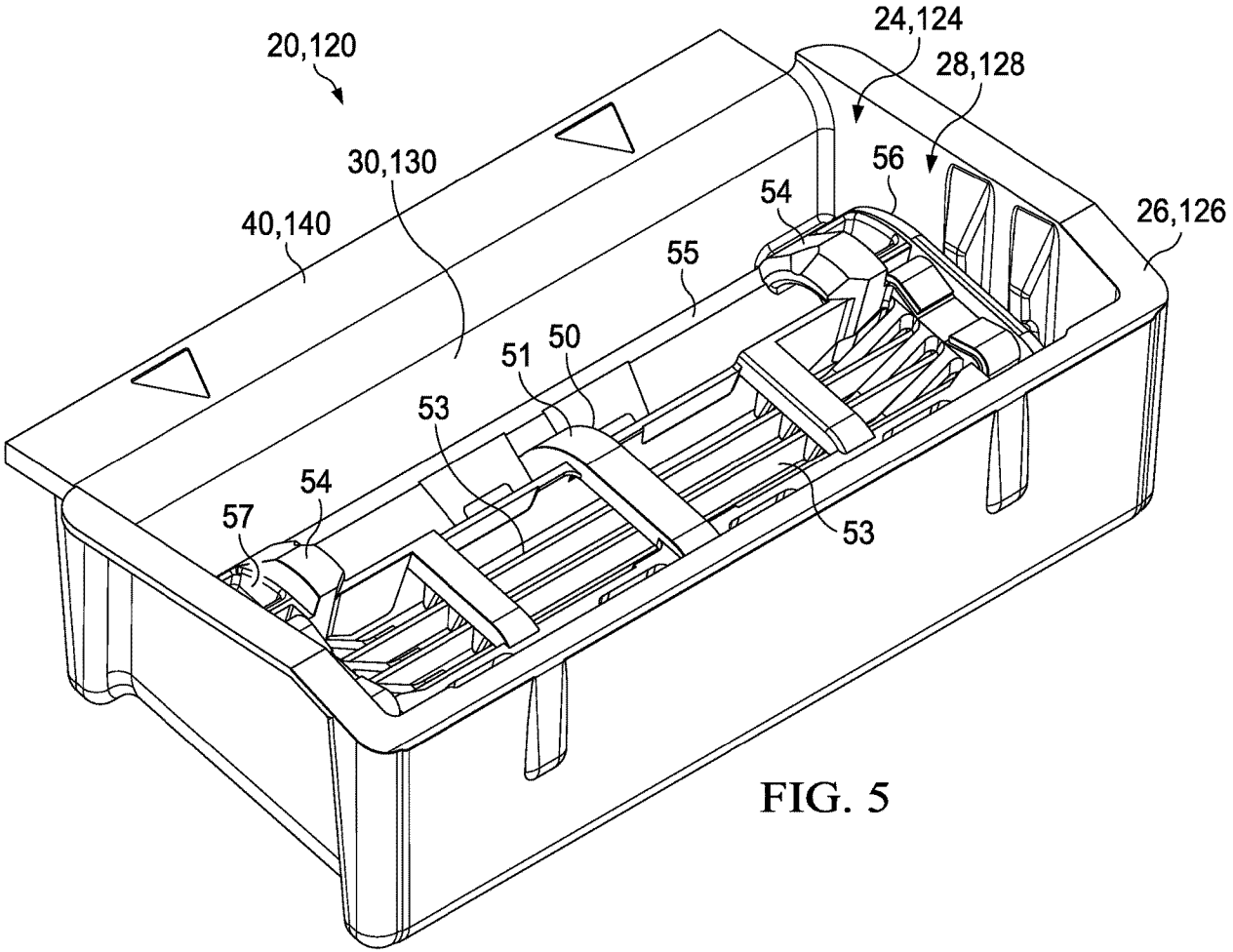
FIG. 5 is a top perspective view of the container of FIGS. 1-4 with a razor cartridge contained within the container.
Figure 6:
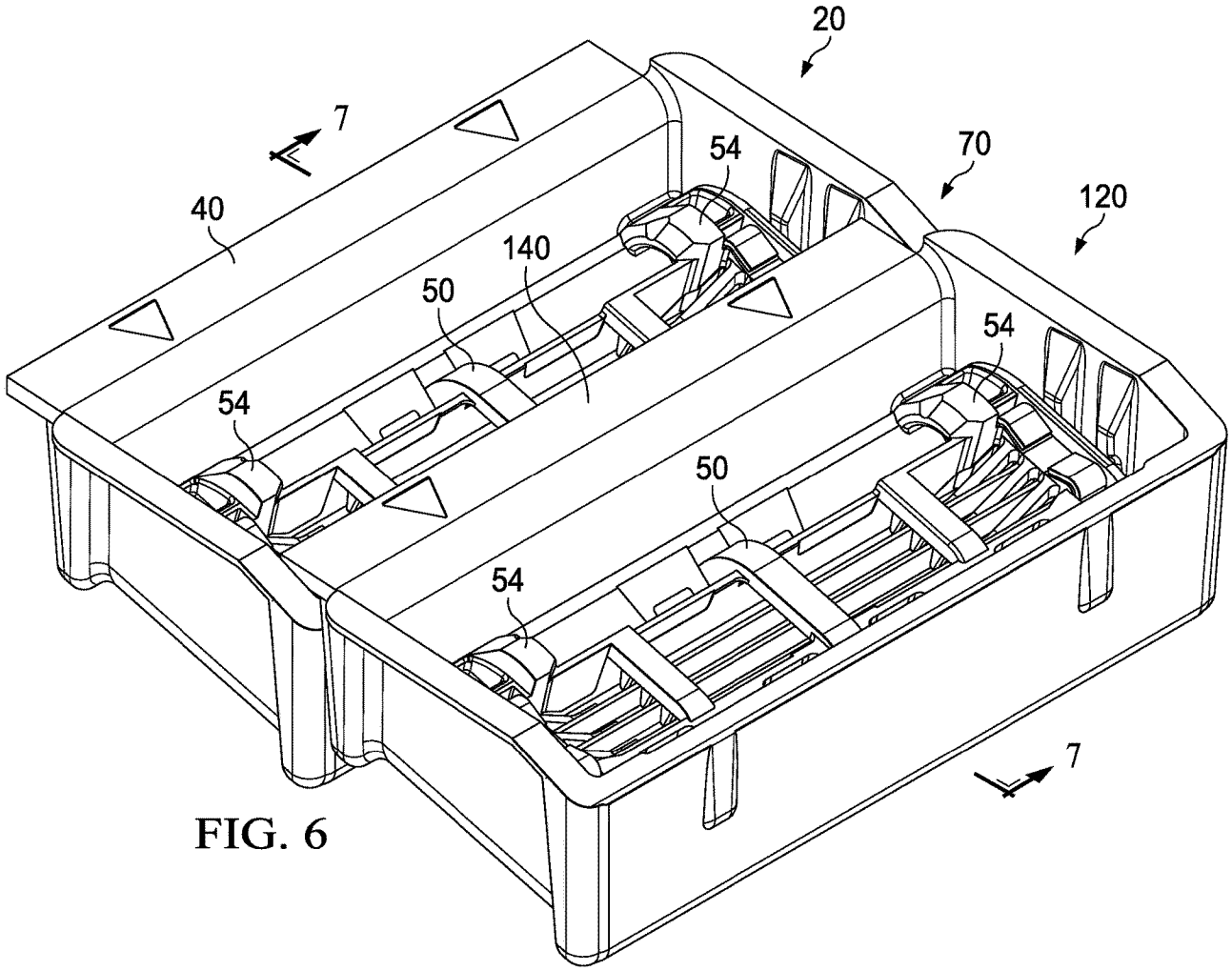
FIG. 6 is a top perspective view of a plurality of interconnected containers.

Referring now to FIG. 5 there is shown a container 20, 120 comprising a storage region 24, 124 and having a perimeter 26, 126 surrounding an entrance 28, 128 to the storage region 24, 124. The container 20, 120 contains a razor cartridge 50. Container 20,120 is the same as container 20 and 120 shown in FIGS. 1-4. Razor cartridge 50 comprises a bottom surface 51 and an opposing top surface (not shown). Razor cartridge 50 comprises a plurality of blades 53. Alternatively, the razor cartridge 50 may comprise a single blade. Razor cartridge 50 comprises a pair of handle connecting members 54 for connecting the razor cartridge 50 to a handle. Alternatively, the razor cartridge 50 may comprise a single handle connecting member. The handle connecting members 54 are positioned near a front portion 55 of the razor cartridge 50 and near an end edge 56, 57 of razor cartridge 50. With respect to container 20, 120 connecting members 54 are positioned near first side wall 30, 130 and front flange 40, 140. Alternatively, the handle connecting members 54 may be positioned near the center of the razor cartridge 50.

Referring now to FIGS. 6-9 there is shown a plurality of interconnected containers, 20 and 120. Containers 20 and 120 are connected together such that the razor cartridges 50 are oriented the same way. This can be seen as the handle connecting members 54 are all positioned on the same side of containers 20 and 120 near front flanges 40, 140. A joint 70 secures the front flange 140 of the second individual container 120 to the second side wall 32 of the first individual container 20 at the perimeter 26 of the first individual container. The front flange 140 of the second individual container 120 extends beyond the second side wall 32 of the first individual container 20 and above the storage region 24 of first individual container 20. As can be seen accessibility to a portion of the razor cartridge 50 contained in the first individual container 20 is obstructed by front flange 140 of the second individual container 120. In contrast the connecting member 54 of razor cartridge 50 contained in the first individual container 20 are readily accessible and are not obstructed by front flange 140 of the second individual container 120. This configuration is ideal as such a configuration directs the user to connect a razor handle properly with the connecting members 54 and not attempt to connect the razor handle with some other portion of the cartridge not meant to be connected to a handle.

Figure 7:
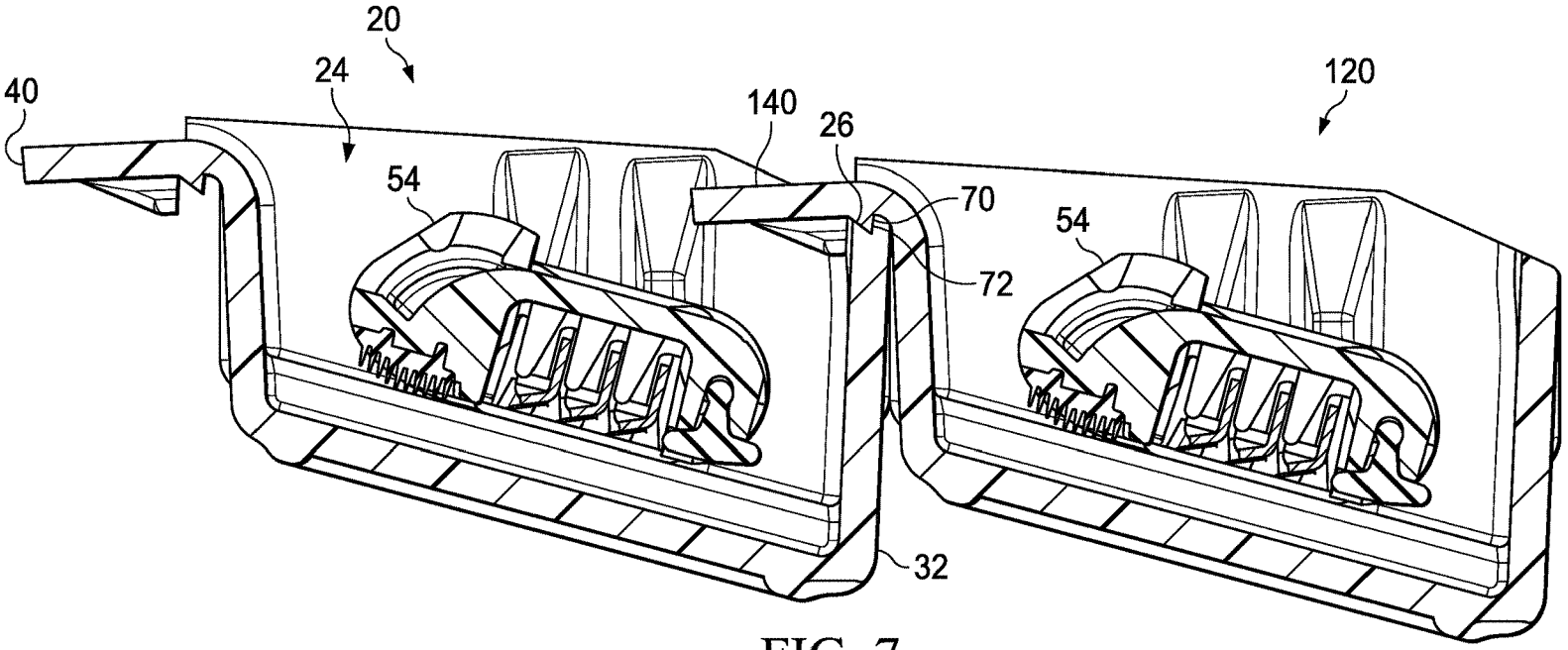
FIG. 7 is a cross-sectional view of the interconnected containers of FIG. 6.
Figure 8:
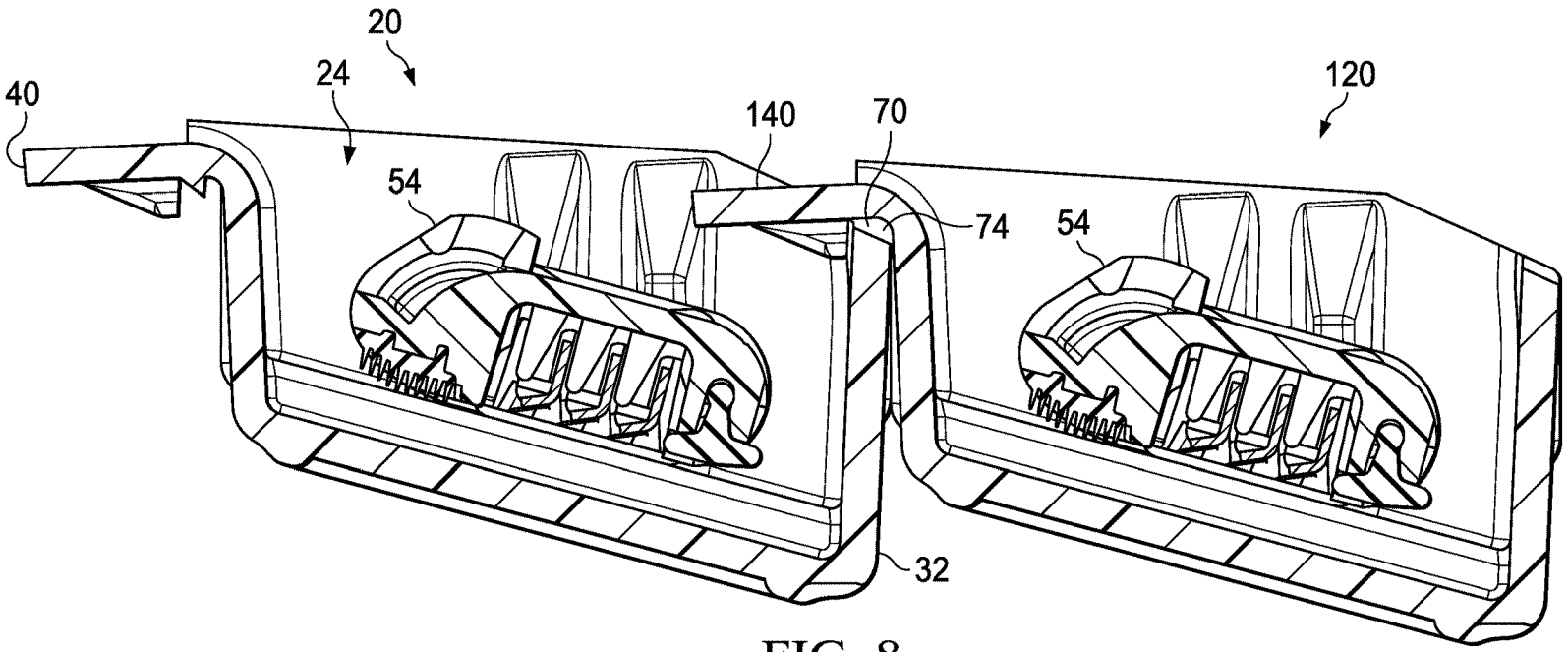
FIG. 8 is a cross-sectional view of interconnected containers.
Figure 9:
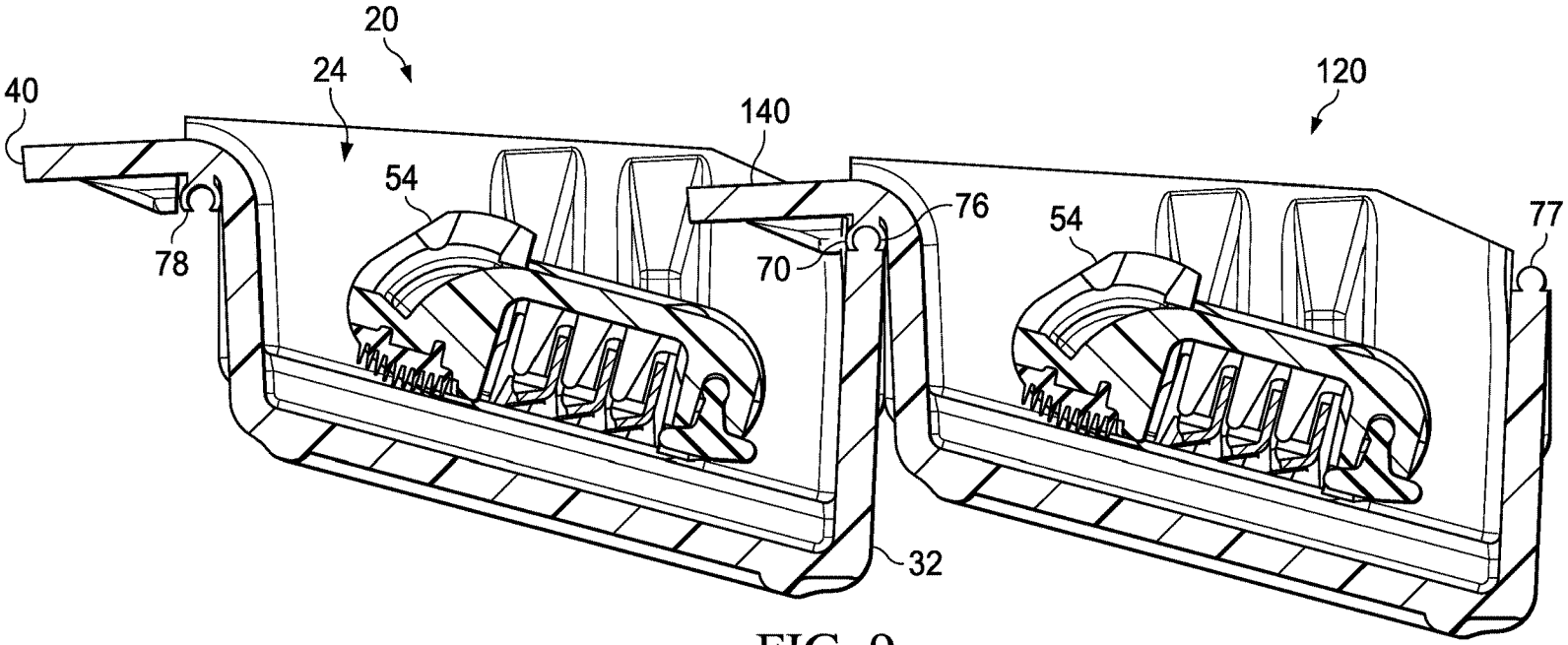
FIG. 9 is a cross-sectional view of interconnected containers.

The joint 70 may comprise a weld, a mechanical joint, or an adhesive. The joint 70 shown in FIG. 7 is a weld 72 and may be either an ultrasonic weld or a laser weld. The weld 72 may be a continuous weld extending uninterrupted. Alternatively the weld 72 may be spaced apart incremental welds 72. The joint 70 shown in FIG. 8 is an adhesive 74. The adhesive 74 may be continuous or spaced apart increments. The joint 70 shown in FIG. 9 is a mechanical joint 76 comprising a protrusion 77 and a socket 78.

While two containers 20 and 120 are shown in FIGS. 6-9, any number of containers may be secured together. It is possible to secure the containers together such that they may be easily separated from one another by the user if desired. Ideally the containers would separate from one another along joint 70. Alternatively, the containers may be secured together making it very difficult for them to be separated by the user.

The containers are preferably formed from plastic. The containers may be manufactured from generally translucent or transparent polymers such that consumers can view the shaving heads. Opaque plastics may even be used if transparency is not required for the containers. Examples of transparent or translucent polymers may include, but are not limited to polyolefins (e.g., polypropylene, high density polyethylene or low density polyethylene), polyesters (e.g., polyethylene terephthalate (PET)), and poly vinyl chloride (PVC). The containers may be produced by thermoforming or other known processing methods such as injection molding, blow molding, cold forming, and injection blow molding.

The containers may also be formed of other materials such as machined metal, cast metal, machined wood, paperboard, and cardboard.

Figure 10:
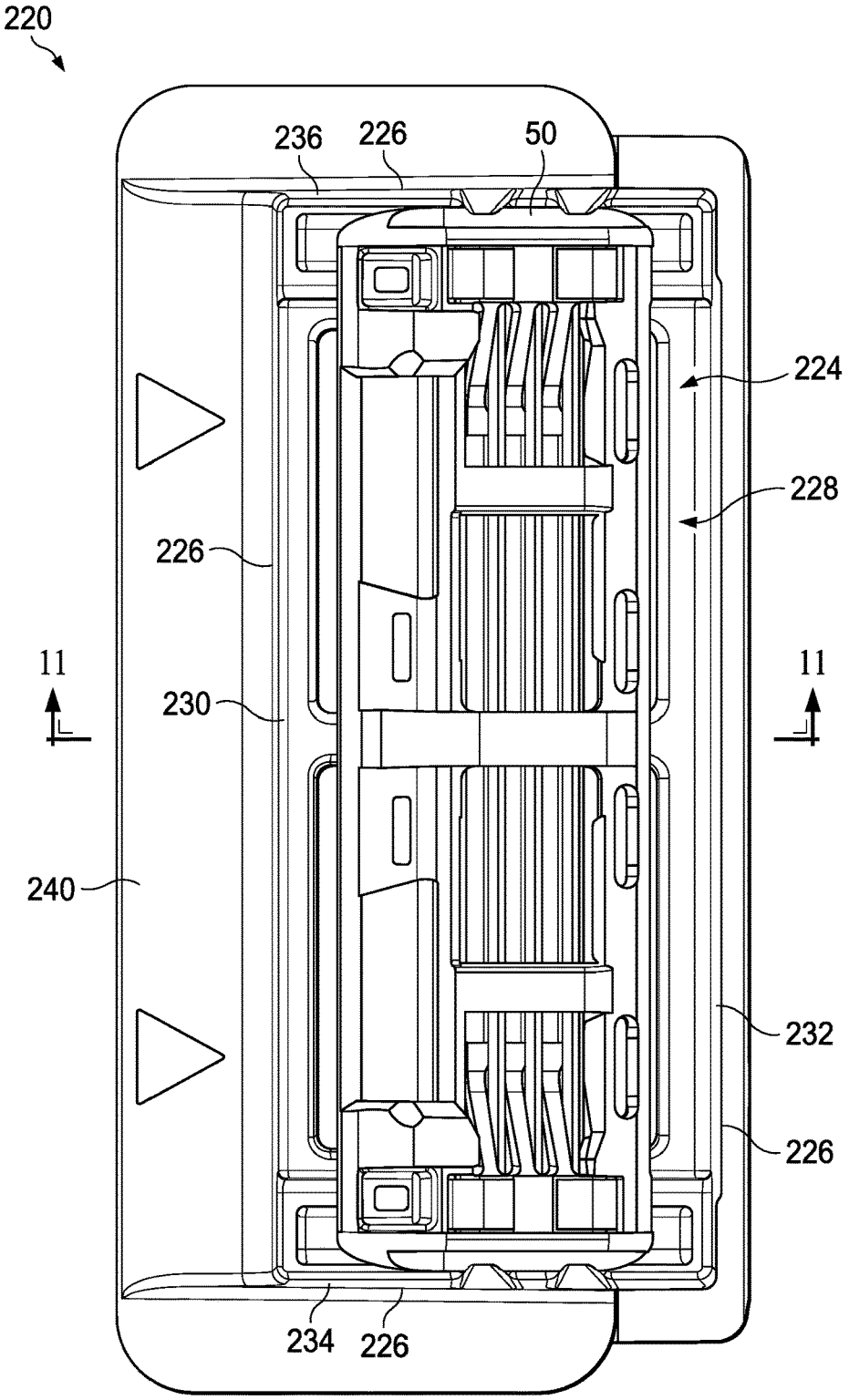
FIG. 10 is a top plan view of another container of the present invention.
Figure 11:
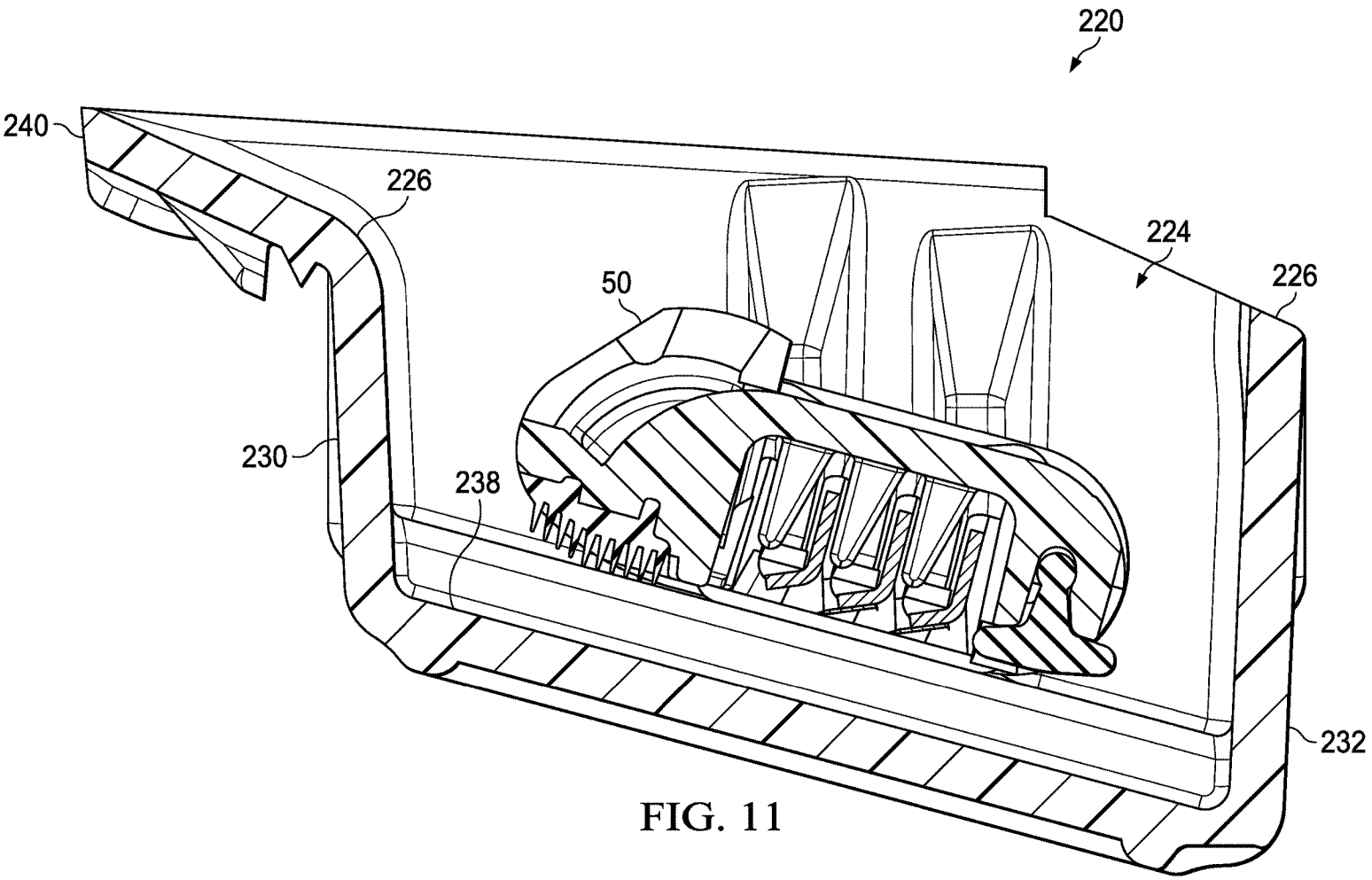
FIG. 11 is a cross-sectional view of the container of FIG. 10.

Referring to FIGS. 10-11 there is shown a first and second individual container 220 of the present invention. The container 220 contains a razor cartridge 50. The container 220 preferably comprises a plastic container defining a storage region 224 and having a perimeter 226 surrounding an entrance 228 to the storage region 224. The container 220 has a first side wall 230, a second side wall 232 opposite the first side wall 230, a first end wall 234, a second end wall 236 opposite the first end wall 234 and a bottom wall 238 extending between the first side wall 230, the second side wall 232, the first end wall 234 and the second end wall 236. A front flange 240 extends outward from the first side wall 230 at the perimeter 226. The front flange 240 of the individual container 220 is at a non-perpendicular angle to the first side wall 230 of the individual container 220.

Figure 12:
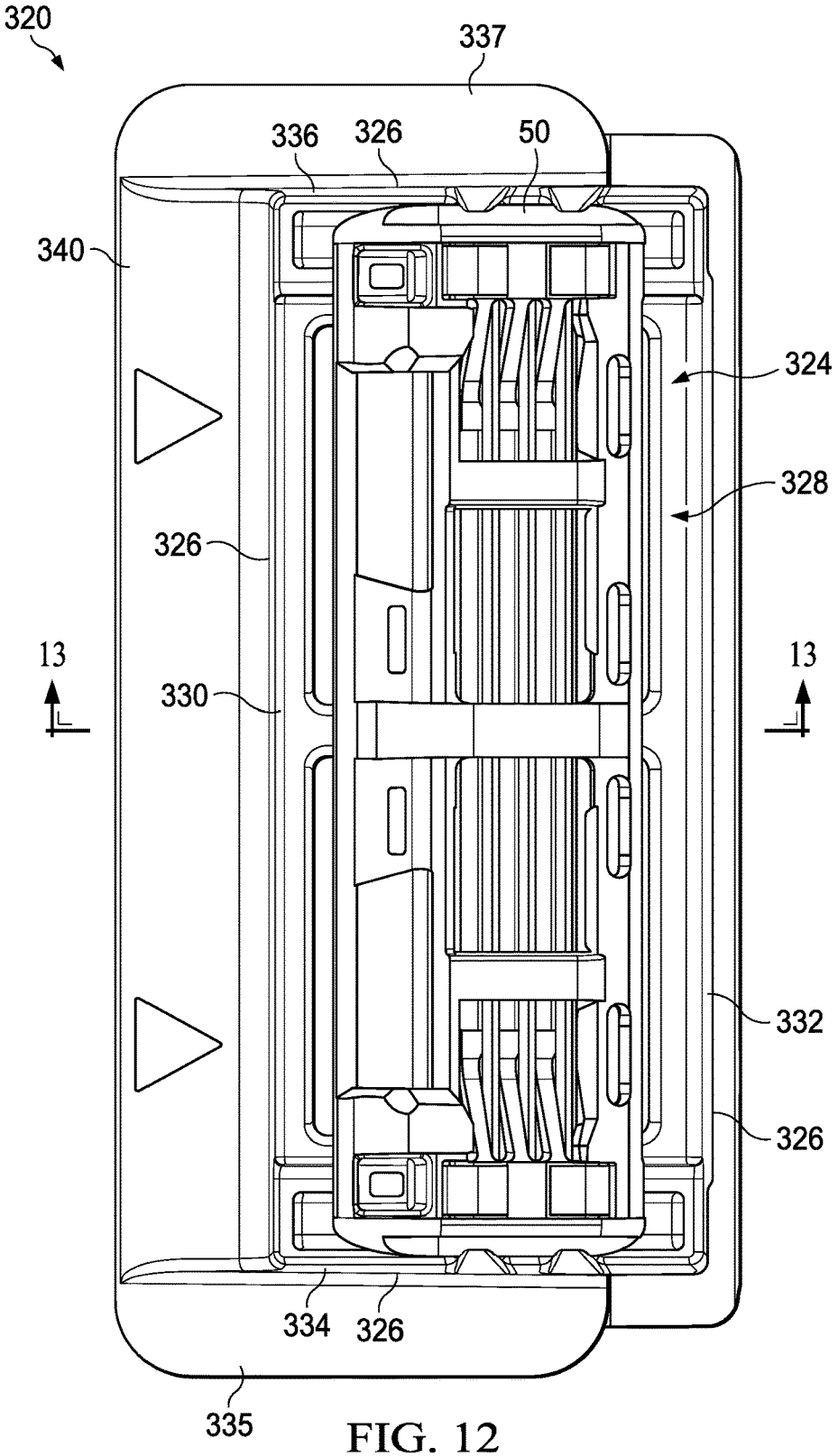
FIG. 12 is a top plan view of another container of the present invention.
Figure 13:
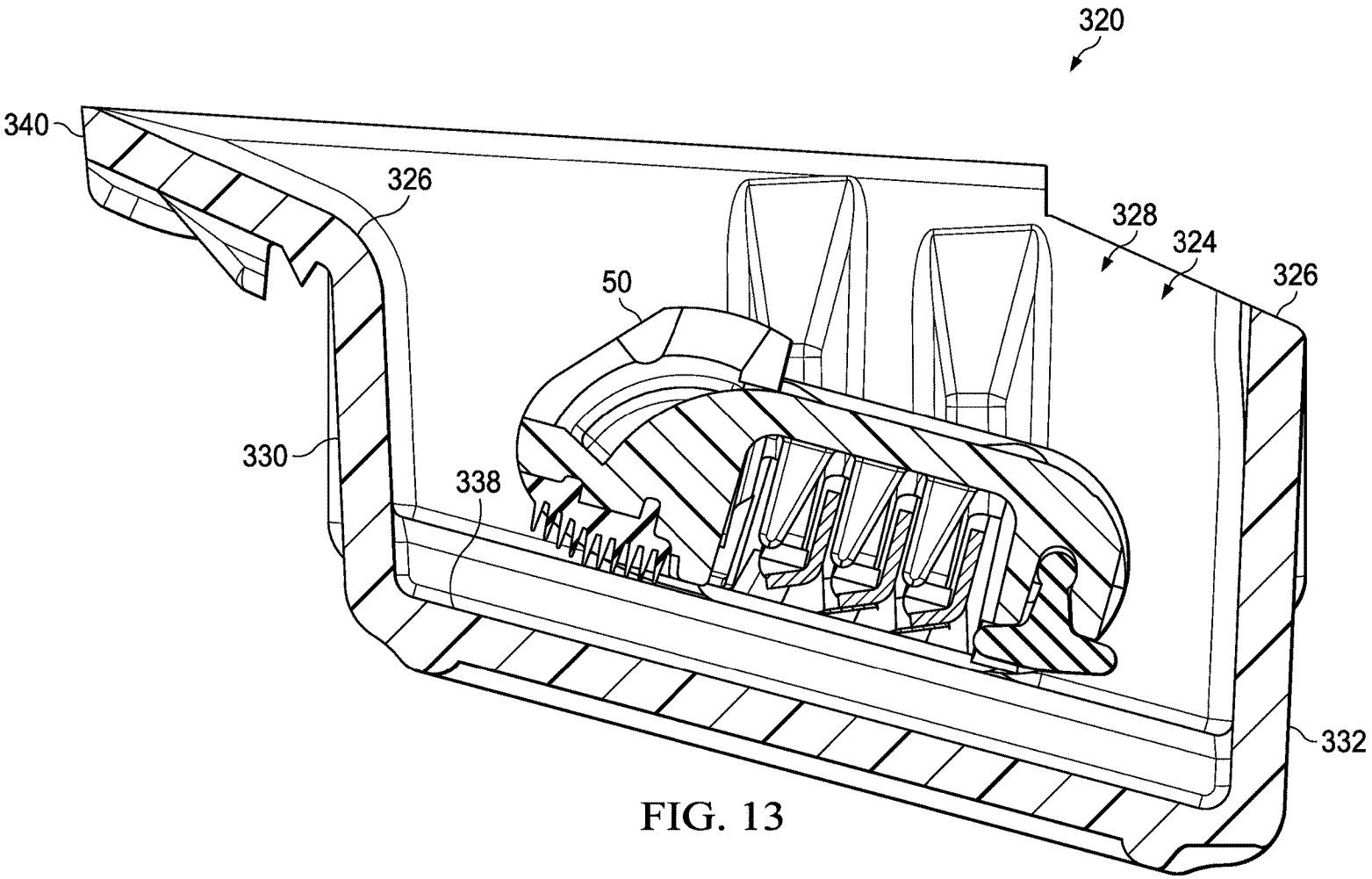
FIG. 13 is a cross-sectional view of the container of FIG. 10.

Referring to FIGS. 12-13 there is shown a first and second individual container 320 of the present invention. The container 320 contains a razor cartridge 50. The container 320 preferably comprises a plastic container defining a storage region 324 and having a perimeter 326 surrounding an entrance 328 to the storage region 324. The container 320 has a first side wall 330, a second side wall 332 opposite the first side wall 330, a first end wall 334, a second end wall 336 opposite the first end wall 334 and a bottom wall 338 extending between the first side wall 330, the second side wall 332, the first end wall 334 and the second end wall 336. A front flange 340 extends outward from the first side wall 330 at the perimeter 326. The front flange 340 of the individual container 320 is at a non-perpendicular angle to the first side wall 330 of the individual container 320. A first end flange 335 extends outward from the first end wall 334 at the perimeter 326. A second end flange 337 extends outward from the second end wall 336 at the perimeter 326. The first end flange 335 may be perpendicular with first end wall 334 or at an angle with first end wall 334. The second end flange 337 may be perpendicular with second end wall 336 or at an angle with second end wall 336.

An example is below:

A. A plurality of connected individual containers for a razor cartridge, comprising:
   a. a first individual container containing a first razor cartridge comprising:
      i. a plastic container defining a storage region and having a perimeter around an entrance to the storage region, the container comprising a first side wall, a second side wall opposite the first side wall, a first end wall, a second end wall opposite the first end wall, a bottom wall extending between the first side wall, the second side wall, the first end wall and the second end wall, and a front flange extending outward from said first side wall at said perimeter, wherein the first razor cartridge is positioned within the storage region;
   b. a second individual container containing a second razor cartridge comprising:
      i. a plastic container defining a storage region and having a perimeter around an entrance to the storage region, the container comprising a first side wall, a second side wall opposite the first side wall, a first end wall, a second end wall opposite the first end wall, a bottom wall extending between the first side wall, the second side wall, the first end wall and the second end wall, and a front flange extending outward from said first side wall at said perimeter, wherein the second razor cartridge is positioned within the storage region;
   c. a joint securing the front flange of the second individual container to the second side wall of the first individual container at the perimeter, the front flange of the second individual container extending beyond said second side wall of the first individual container and above the storage region of first individual container.

B. The plurality of connected individual containers of paragraph A, wherein the joint comprises a weld, a mechanical joint, or an adhesive.

C. The plurality of connected individual containers of paragraphs A or B, wherein said weld comprises an ultrasonic weld or a laser weld.

D. The plurality of connected individual containers of any one of paragraphs A-C, wherein the front flange of the first individual container is at a non-perpendicular angle to the first side wall of the first individual container.

E. The plurality of connected individual containers of any one of paragraphs A-D, wherein the front flange of the second individual container is at a non-perpendicular angle to the first side wall of the second individual container.

F. The plurality of connected individual containers of any one of paragraphs A-E, wherein the front flange of the first individual container is perpendicular to the first side wall of the first individual container.

G. The plurality of connected individual containers of any one of paragraphs A-G, wherein the front flange of the second individual container is perpendicular to the first side wall of the second individual container.

H. A plurality of connected individual containers for a razor cartridge, comprising:

a. a first individual container containing a first razor cartridge comprising:

i. a plastic container defining a storage region and having a perimeter around an entrance to the storage region, the container comprising a first side wall, a second side wall opposite the first side wall, a first end wall, a second end wall opposite the first end wall, a bottom wall extending between the first side wall, the second side wall, the first end wall and the second end wall, a first end flange extending outward from said first end wall at said perimeter, a second end flange extending outward from said second end wall at said perimeter, and a front flange extending outward from said first side wall at said perimeter, wherein the first razor cartridge is positioned within the storage region;

b. a second individual container containing a second razor cartridge comprising:

i. a plastic container defining a storage region and having a perimeter around an entrance to the storage region, the container comprising a first side wall, a second side wall opposite the first side wall, a first end wall, a second end wall opposite the first end wall, a bottom wall extending between the first side wall, the second side wall, the first end wall and the second end wall, a first end flange extending outward from said first end wall at said perimeter, a second end flange extending outward from said second end wall at said perimeter, and a front flange extending outward from said first side wall at said perimeter, wherein the second razor cartridge is positioned within the storage region;

c. a joint securing the front flange of the second individual container to the second side wall of the first individual container at the perimeter, the front flange of the second individual container extending beyond said second side wall of the first individual container and above the storage region of first individual container.

I. The plurality of connected individual containers of paragraph H, wherein the joint comprises a weld, a mechanical joint, or an adhesive.

J. The plurality of connected individual containers of paragraph I, wherein said weld comprises an ultrasonic weld or a laser weld.

K. The plurality of connected individual containers of any one of paragraphs H-J, wherein the front flange of the first individual container is at a non-perpendicular angle to the first side wall of the first individual container.

L. The plurality of connected individual containers of any one of paragraphs H-K, wherein the front flange of the second individual container is at a non-perpendicular angle to the first side wall of the second individual container.

M. The plurality of connected individual containers of any one of paragraphs H-L, wherein the front flange of the first individual container is perpendicular to the first side wall of the first individual container.

N. The plurality of connected individual containers of any one of paragraphs H-M, wherein the front flange of the second individual container is perpendicular to the first side wall of the second individual container.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A plurality of connected individual containers for a razor cartridge, comprising:

a. a first individual container containing a first razor cartridge comprising:

i. a plastic container defining a storage region and having a perimeter around an entrance to the storage region, the container comprising a first side wall, a second side wall opposite the first side wall, a first end wall, a second end wall opposite the first end wall, a bottom wall extending between the first side wall, the second side wall, the first end wall and the second end wall, and a front flange extending outward from said first side wall at said perimeter and perpendicular to the first side wall, wherein the first razor cartridge is positioned within the storage region;

b. a second individual container containing a second razor cartridge comprising:

i. a plastic container defining a storage region and having a perimeter around an entrance to the storage region, the container comprising a first side wall, a second side wall opposite the first side wall, a first end wall, a second end wall opposite the first end wall, a bottom wall extending between the first side wall, the second side wall, the first end wall and the second end wall, and a front flange extending outward from said first side wall at said perimeter, wherein the second razor cartridge is positioned within the storage region;

c. a joint securing the front flange of the second individual container to the second side wall of the first individual container at the perimeter, the front flange of the second individual container extending beyond said second side wall of the first individual container and above the storage region of first individual container.

2. The plurality of connected individual containers of claim 1, wherein the joint comprises a weld, a mechanical joint, or an adhesive.

3. The plurality of connected individual containers of claim 2, wherein said weld comprises an ultrasonic weld or a laser weld.

4. The plurality of connected individual containers of claim 1, wherein the front flange of the first individual container is at a non-perpendicular angle to the first side wall of the first individual container.

5. The plurality of connected individual containers of claim 1, wherein the front flange of the second individual container is at a non-perpendicular angle to the first side wall of the second individual container.

6. The plurality of connected individual containers of claim 1, wherein the front flange of the second individual container is perpendicular to the first side wall of the second individual container.

7. A plurality of connected individual containers for a razor cartridge, comprising:

a. a first individual container containing a first razor cartridge comprising:

i. a plastic container defining a storage region and having a perimeter around an entrance to the storage region, the container comprising a first side wall, a second side wall opposite the first side wall, a first end wall, a second end wall opposite the first end wall, a bottom wall extending between the first side wall, the second side wall, the first end wall and the second end wall, a first end flange extending outward from said first end wall at said perimeter, a second end flange extending outward from said second end wall at said perimeter, and a front flange extending outward from said first side wall at said perimeter, wherein the first razor cartridge is positioned within the storage region;

b. a second individual container containing a second razor cartridge comprising:

i. a plastic container defining a storage region and having a perimeter around an entrance to the storage region, the container comprising a first side wall, a second side wall opposite the first side wall, a first end wall, a second end wall opposite the first end wall, a bottom wall extending between the first side wall, the second side wall, the first end wall and the second end wall, a first end flange extending outward from said first end wall at said perimeter, a second end flange extending outward from said second end wall at said perimeter, and a front flange extending outward from said first side wall at said perimeter, wherein the second razor cartridge is positioned within the storage region;

c. a joint securing the front flange of the second individual container to the second side wall of the first individual container at the perimeter, the front flange of the second individual container extending beyond said second side wall of the first individual container and above the storage region of first individual container.

8. The plurality of connected individual containers of claim 7, wherein the joint comprises a weld, a mechanical joint, or an adhesive.

9. The plurality of connected individual containers of claim 8, wherein said weld comprises an ultrasonic weld or a laser weld.

10. The plurality of connected individual containers of claim 7, wherein the front flange of the first individual container is at a non-perpendicular angle to the first side wall of the first individual container.

11. The plurality of connected individual containers of claim 7, wherein the front flange of the second individual container is at a non-perpendicular angle to the first side wall of the second individual container.

12. The plurality of connected individual containers of claim 7, wherein the front flange of the first individual container is perpendicular to the first side wall of the first individual container.

13. The plurality of connected individual containers of claim 7, wherein the front flange of the second individual container is perpendicular to the first side wall of the second individual container.

* * * * *